US009249568B2

(12) United States Patent
Hoefler

(10) Patent No.: US 9,249,568 B2
(45) Date of Patent: Feb. 2, 2016

(54) PORTABLE, TEMPORARY WALL SYSTEM

(71) Applicant: James M. Hoefler, Carlisle, PA (US)

(72) Inventor: James M. Hoefler, Carlisle, PA (US)

( * ) Notice: Subject to any disclaimer, the term of this patent is extended or adjusted under 35 U.S.C. 154(b) by 0 days.

(21) Appl. No.: 14/595,787

(22) Filed: Jan. 13, 2015

(65) Prior Publication Data

US 2015/0233114 A1 Aug. 20, 2015

Related U.S. Application Data

(60) Provisional application No. 61/940,632, filed on Feb. 17, 2014.

(51) Int. Cl.
*E04B 2/74* (2006.01)
*E04B 2/82* (2006.01)

(52) U.S. Cl.
CPC ..... *E04B 2/7433* (2013.01); *E04B 2/821* (2013.01); *E04B 2002/749* (2013.01)

(58) Field of Classification Search
CPC ..... E04B 2002/749; E04B 2002/7492; E04B 2002/7453; E04B 2002/7483; E04B 2002/74; E04B 2/7433; E04B 2/7459; E05Y 2900/142; A47B 96/04
See application file for complete search history.

(56) References Cited

U.S. PATENT DOCUMENTS 2,763,342 A * 9/1956 French ..... E04B 2/825 403/107
2,949,984 A * 8/1960 Daniels ..... E04B 1/36 248/188.4
3,083,795 A * 4/1963 Land ..... E04B 2/821 248/354.3
3,111,723 A * 11/1963 Bates ..... E04B 2/821 160/135
3,762,116 A * 10/1973 Anderson ..... E04B 2/7444 160/135
3,766,692 A * 10/1973 Stark ..... E04B 2/7444 160/135
3,842,555 A * 10/1974 Korell ..... E04B 2/74 403/170
3,877,191 A * 4/1975 Munsey ..... E04B 2/7444 439/209
3,990,204 A * 11/1976 Haworth ..... E04B 2/7427 160/135
4,048,775 A * 9/1977 Dielman ..... E04H 1/1266 52/127.12
4,086,734 A * 5/1978 Hayashi ..... E04B 2/82 52/126.4
4,203,639 A * 5/1980 VandenHoek ..... E04B 2/7427 174/481
4,221,086 A * 9/1980 Berman ..... E04B 2/74 160/135
4,277,920 A * 7/1981 Dixon ..... E04B 2/824 49/321
4,449,337 A * 5/1984 Gzym ..... E04B 2/825 52/126.4
4,454,690 A * 6/1984 Dixon ..... E04B 2/824 52/126.3
4,719,731 A * 1/1988 Ravotti ..... E04B 2/7444 52/239

(Continued)

*Primary Examiner* — Elizabeth A Plummer
*Assistant Examiner* — Kyle Walraed-Sullivan
(74) *Attorney, Agent, or Firm* — McNees Wallace & Nurick LLC

(57) ABSTRACT

The present invention relates to temporary wall systems and their production and more particularly to portable, temporary wall systems. The wall system includes an adjustable pillar member, a panel member, and a support article arranged and disposed to secure the panel member to the adjustable pillar member. The adjustable pillar member includes a base portion and an expansion portion, and is configured to extend between opposing surfaces to provide support for the panel member when secured thereto. The base portion includes a first face, an opposing second face, and a channel formed in the first face, the channel extending from the first face towards the second face. The expansion portion is movably disposed within the channel, and at least partially extends from the first face of the base portion.

18 Claims, 10 Drawing Sheets

(56) References Cited

U.S. PATENT DOCUMENTS 4,858,386 A * 8/1989 Nail ..... E06B 1/524 49/505
4,991,365 A * 2/1991 Jackson ..... A47B 91/024 160/135
5,159,793 A * 11/1992 Deugo ..... E04B 2/7409 52/126.1
5,218,797 A * 6/1993 Kruse ..... E01F 8/0017 52/169.9
5,274,970 A * 1/1994 Roberts ..... E04B 2/7409 160/135
5,471,791 A * 12/1995 Keller ..... E04B 2/827 160/40
5,666,774 A * 9/1997 Commins ..... E04H 12/2253 248/188.4
5,913,783 A * 6/1999 Weener ..... A47B 96/1425 248/354.1
6,058,665 A * 5/2000 Halvorson, Jr. ..... E05D 15/48 49/159
2006/0230705 A1* 10/2006 Grandi ..... E04B 2/821 52/764
2007/0107335 A1* 5/2007 Laukhuf ..... E04B 2/7422 52/239
2008/0209827 A1* 9/2008 Webb ..... E04B 2/821 52/220.7
2015/0052829 A1* 2/2015 Babikian ..... E04B 2/74 52/126.4

* cited by examiner

PORTABLE, TEMPORARY WALL SYSTEM

CROSS-REFERENCE TO RELATED APPLICATION

The present application claims the benefit of and priority to U.S. Provisional Patent Application No. 61/940,632 entitled "PORTABLE, TEMPORARY WALL SYSTEM," filed on Feb. 17, 2014, which is hereby incorporated by reference in its entirety.

FIELD OF THE INVENTION

The present application is directed toward the field of temporary wall systems and their production and more particularly to portable, temporary wall systems.

BACKGROUND OF THE INVENTION

Often, it is desirable to divide rooms into sections or subsections of an original configuration. For example, homeowners and apartment renters may wish to divide rooms in order to provide privacy, or make more efficient and creative use of the existing space. However, currently available devices and/or methods include various disadvantages and drawbacks, leaving a variety of commercial needs which have not yet been met.

One currently available device includes a room divider, such as a hinged room divider screen. Although room divider screens may be easy to assemble and disassemble, and may include decreased cost, they also are often flimsy and easily knocked over while offering minimal privacy. Another method includes using existing furniture, such as a bookcase or other tall pieces of furniture (e.g., free-standing wardrobes), to partially separate rooms. However, furniture can be heavy and difficult to move, expensive, include unfinished portions, and/or create substantial and potentially dangerous tip-over hazards.

Traditionally built stationary walls, erected with studs, bottom plates, top plates, and clad with sheets of drywall, may be sturdier and provide increased privacy as compared to room dividers or pieces of furniture. However, stationary walls include significant drawbacks such as possibly requiring a building permit to erect, requiring expertise to construct, being difficult to remove, and leaving marks or holes in the floor, ceiling, and adjoining walls. Additionally, stationary walls are often erected and dismantled in a manner that makes it difficult to reclaim the materials in a useable form.

As an alternative to traditionally built stationary walls, pressurized walls may be constructed by expanding leveling screws within vertical studs to create a snug, pressurized fit of the stud against the floor and ceiling. Sheets of drywall are then attached to the studs, and the wall is finished with drywall tape, drywall compound, and paint. Although pressurized walls provide a temporary solution without forming holes in the floor or ceiling, they also include various drawbacks. Such drawbacks include potentially violating municipal building codes, being expensive to construct, and possibly requiring a contractor to dismantle the wall when no longer wanted, which may result in the contractor claiming the dismantled building materials. When the contractor claims the dismantled building materials, the consumer not only pays for the contractor's time, but also realizes no equity in the original purchase of the pressurized wall.

A portable, temporary wall system that shows one or more improvements in comparison to current solutions would be desirable in the art.

BRIEF DESCRIPTION OF THE INVENTION

Exemplary embodiments are directed to wall systems including, but not limited to, temporary, portable wall systems that address currently existing but unmet needs. More particularly, exemplary embodiments are directed to wall systems constructed with adjustable pillar members and wall panel members.

In one embodiment, a wall system includes an adjustable pillar member, a panel member, and a support article arranged and disposed to secure the panel member to the adjustable pillar member. The adjustable pillar member includes a base portion and an expansion portion, and is configured to extend between opposing surfaces to provide support for the panel member when secured thereto. The base portion includes a first face, an opposing second face, and a channel formed in the first face, the channel extending from the first face towards the second face. The expansion portion is movably disposed within the channel, and at least partially extends from the first face of the base portion.

In another embodiment, a wall system includes at least two adjustable pillar members, at least two panel members, a support article coupled to each of the adjustable pillar members, a clasp, and a leveling device. The support article is arranged and disposed to secure at least one of the panel members to the adjustable pillar member, the clasp is provided to secure the panel members to each other, and the leveling device provides support for the panel members extending between the adjustable pillar members. Each of the adjustable pillar members includes a base portion and an expansion portion, and is configured to extend between opposing surfaces to provide support for the panel members when secured thereto. The base portion includes a first face, an opposing second face, and a channel formed in the first face, the channel extending from the first face towards the second face. The expansion portion is movably disposed within the channel, and includes an elongated member with a proximal end inserted within the base portion and a distal end extending from the base portion, and an expansion plate secured to the distal end of the elongated member.

An advantage of exemplary embodiments is that the adjustable pillar members and the panel members form a temporary and/or portable wall system.

Another advantage of exemplary embodiments is that the adjustable pillar members and the panel members form the wall system without forming holes or otherwise damaging surrounding structures.

Yet another advantage of exemplary embodiments is an ability for an individual having no special building skills to assemble and disassemble the wall system in a short period of time.

Still another advantage of exemplary embodiments is that the wall system provides a stable, removable structure for dividing rooms.

Another advantage of exemplary embodiments is an ability to customize the configuration and/or design of the wall system.

Other features and advantages of the present invention will be apparent from the following more detailed description, taken in conjunction with the accompanying drawings which illustrate, by way of example, the principles of the invention.

Any dimensions shown in the figures are for exemplary purposes only, and are not intended to limit the scope of the disclosure.

DETAILED DESCRIPTION

Figure 1:
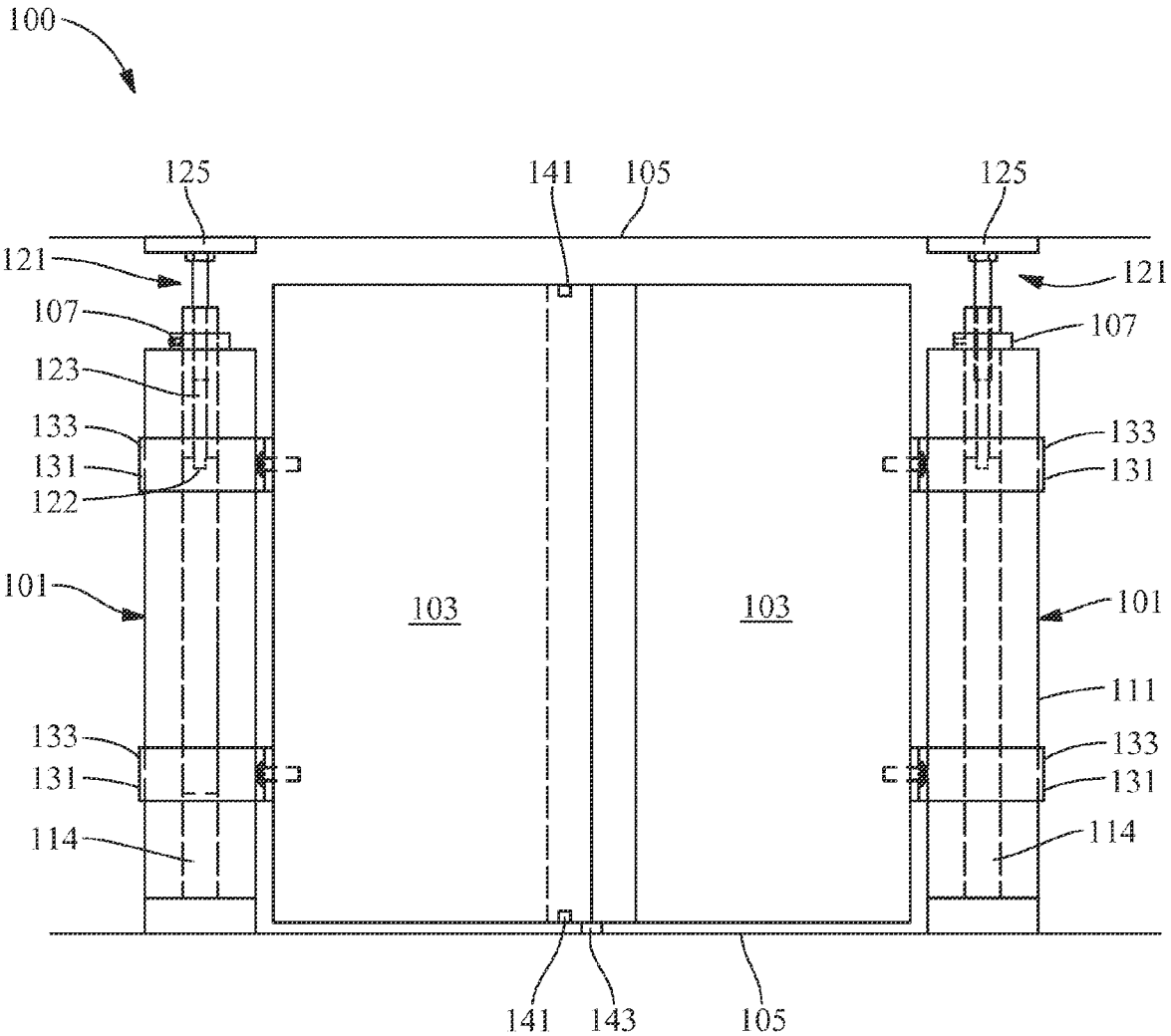
FIG. 1 shows a front view of a wall system, according to an embodiment of the disclosure.

Referring to FIG. 1, a wall system 100 includes at least one adjustable pillar member 101 and at least one panel member 103. The adjustable pillar member 101 includes a base portion 111 and an expansion portion 121. The panel member 103 includes any suitable structure for being secured to the adjustable pillar member 101 and forming a portion of the wall system 100. For example, suitable structures include a door, a wood panel (e.g., plywood, engineered wood, particle board, hardwood), a metal panel, a sheet of solid or opaque material, any structure for reducing the transmission of noise, or a combination thereof. As described in detail below, the at least one adjustable pillar member 101 and the at least one panel member 103 may be used to form a temporary, customizable, and/or portable wall system.

Figure 3:
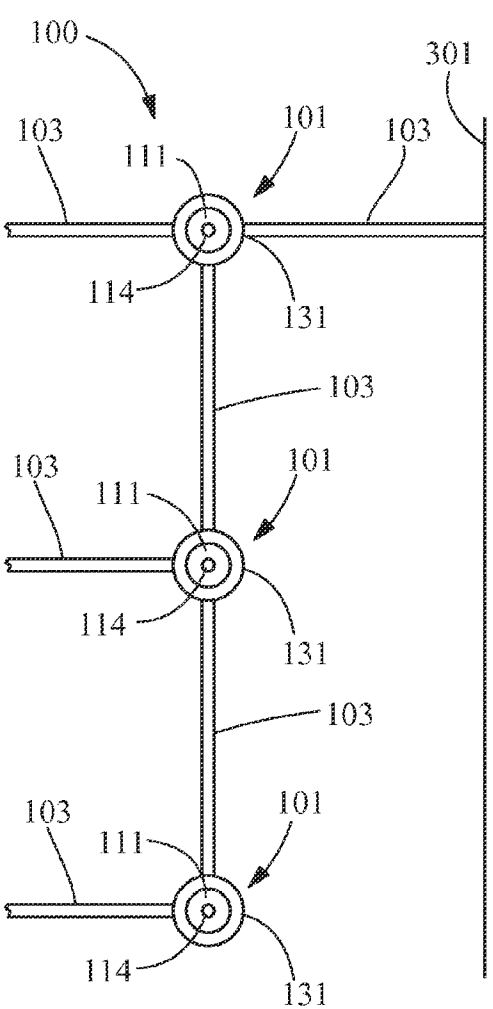
FIG. 3 shows a top view of a wall system coupled to a fixed structure.
Figure 2:
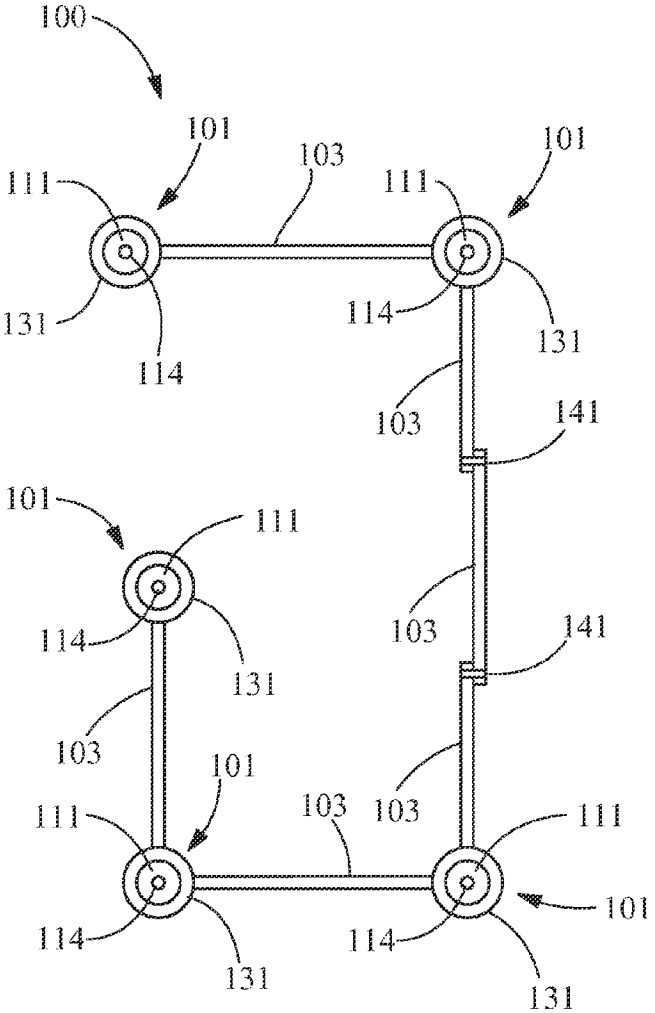
FIG. 2 shows a top view of a free standing wall system.

To form the wall system 100, the adjustable pillar members 101 are fixed in position between opposing surfaces 105, such as, for example, a floor and a ceiling, and one or more of the panel members 103 are secured to the adjustable pillar members 101. The wall system 100 includes any suitable combination of panel members 103 and adjustable pillar members 101 to provide a desired configuration. For example, as illustrated in FIGS. 1-2, one or more of the panel members 103 may be supported between two or more of the adjustable pillar members 101. Alternatively, as illustrated in FIG. 3, one or more of the panel members 103 may be supported between one of the adjustable pillar members 101 and an existing structure 301, such as a fixed wall. By supporting the panel members 103 between the adjustable pillar members 101 (FIGS. 1-2), without securing the panel members 103 to the existing structures 301, the wall system 100 divides an area without forming holes or otherwise damaging the existing structures 301.

Figure 4B:
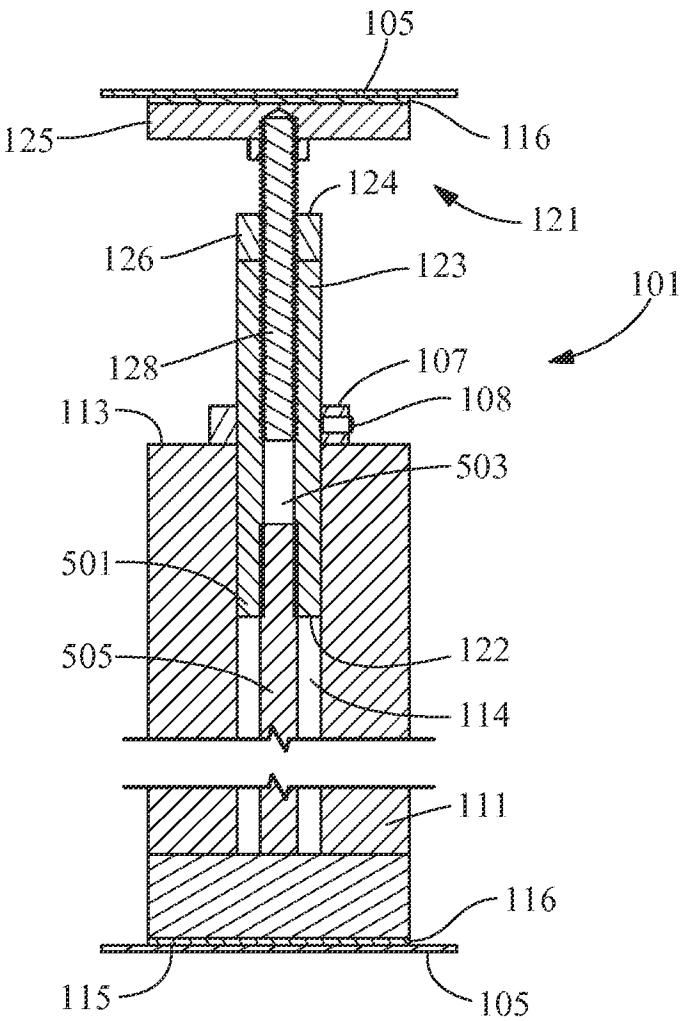
FIG. 4*b* shows a front view of an adjustable pillar member in an extended position.
Figure 4A:
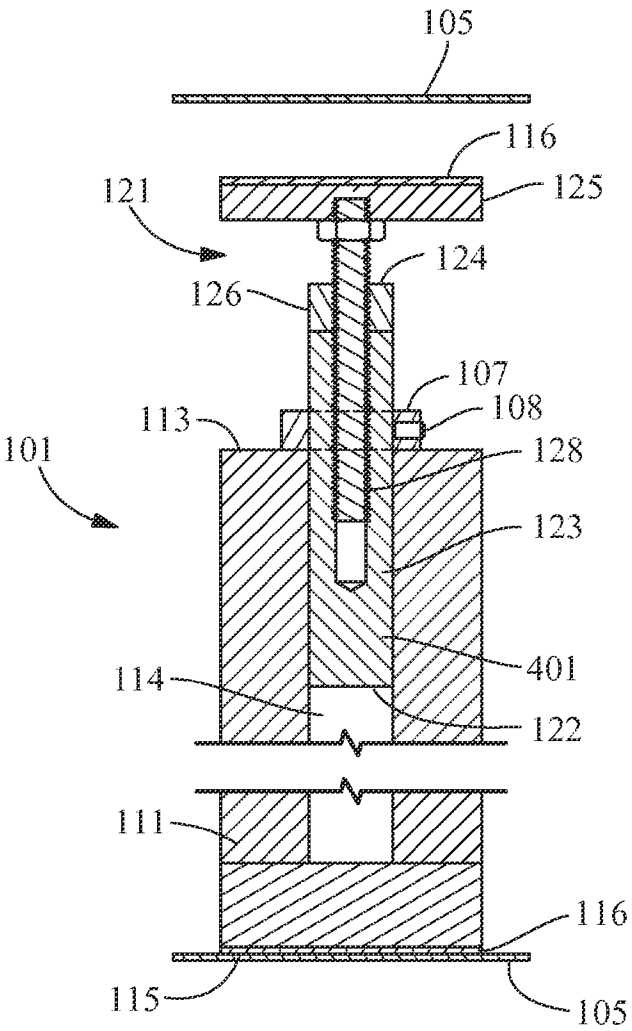
FIG. 4*a* shows a front view of an adjustable pillar member in a collapsed position.

Referring to FIGS. 4*a*-4*b*, the adjustable pillar member 101 is configured to expand and retract between the opposing surfaces 105. In one embodiment, the expansion portion 121 includes an elongated member 123 having a proximal end 122 and a distal end 124. In another embodiment, the base portion 111 is configured to at least partially receive the proximal end 122 of the elongated member 123 therein. As used herein, the proximal end 122 refers to the end of the elongated member 123 that is inserted within the base portion 111, while the distal end 124 refers to the end that extends from the base portion 111.

The elongated member 123 includes any component capable of retracting within (FIG. 4*a*), and extending from (FIG. 4*b*), the base portion 111. Suitable components include a sliding member 401, a threaded member 501, a telescoping member, or a combination thereof. For example, in one embodiment, as illustrated in FIG. 4*a*, the sliding member 401 includes, but is not limited to, a pipe, a cylinder, a rod, a dowel, a post, any other member having a geometry suitable for sliding relative to the base portion 111, or a combination thereof. In another example, as illustrated in FIG. 4*b*, the threaded member 501 includes an internally threaded member, such as a pipe, having an internally threaded opening 503 extending at least partially there through. The internally threaded opening 503 is complementary to a threaded projection 505 within the base portion 111, such that rotation of the threaded member 501 provides linear movement of the elongated member 123 along the threaded projection 505. In an alternate embodiment, at least a portion of an exterior surface of the elongated member 123 and at least a portion of an interior surface of the channel 114 include complementary threading. The threading on the exterior surface of the elongated member 123 engages the threading on the interior surface of the channel 114 such that rotation of the elongated member 123 provides linear movement of the elongated member 123 within the channel 114.

The elongated member 123 and/or the expansion portion 121 are formed from any material or combination of materials capable of applying pressure to the opposing surfaces 105 and supporting the wall system 100. Suitable materials include, but are not limited to, wood; engineered wood; metal, such as aluminum; metal alloy, such as steel, stainless steel, or aluminum alloys; plastic; polymer; or a combination thereof. Additionally, the materials within the expansion portion 121 may be varied, such as, for example, within or between different components of the expansion portion 121.

Figure 6:
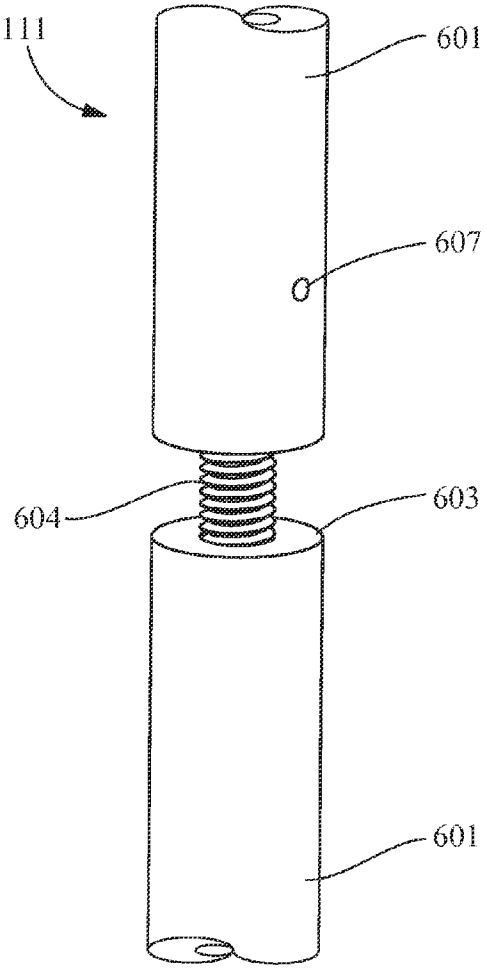
FIG. 6 shows a perspective view of an elongated member.

Referring to FIG. 6, in one embodiment, the base portion 111 includes two or more sections 601. Each of the sections 601 includes a threaded coupling 603 inserted within a mating end thereof. In another embodiment, at least one of the sections 601 includes a coupling stop, such as a spring pin 607, to restrict rotation of the threaded coupling 603 within the section 601. Each of the threaded couplings 603 is configured to engage a threaded stud 604, which is positioned between the mating ends of the sections 601. At least one of the sections 601 is rotated to move the section 601 along the threaded stud 604, which increases or decreases a distance between the mating ends of the sections 601. For example, in a further embodiment, the section 601 without the spring pin 607 is rotated while the section 601 with the spring pin 607 is held stationary, the rotation of the section 601 without the spring pin 607 decreasing the distance between the sections 601 until the mating ends thereof contact each other. When the mating ends are in contact, the sections 601 form the elongated member 111 having an uninterrupted or substantially uninterrupted outer and/or inner surface. The elongated member 111 may be divided into any suitable number of sections to facilitate shipping and/or storage of the wall system 100. The dimensions of each section may be varied during manufacturing to vary the overall dimensions of the wall system 100. For example, one or more of the sections and/or the elongated member 123 may include an increased and/or decreased length to increase and/or decrease the height of the pillar members 103, respectively.

Figure 5:
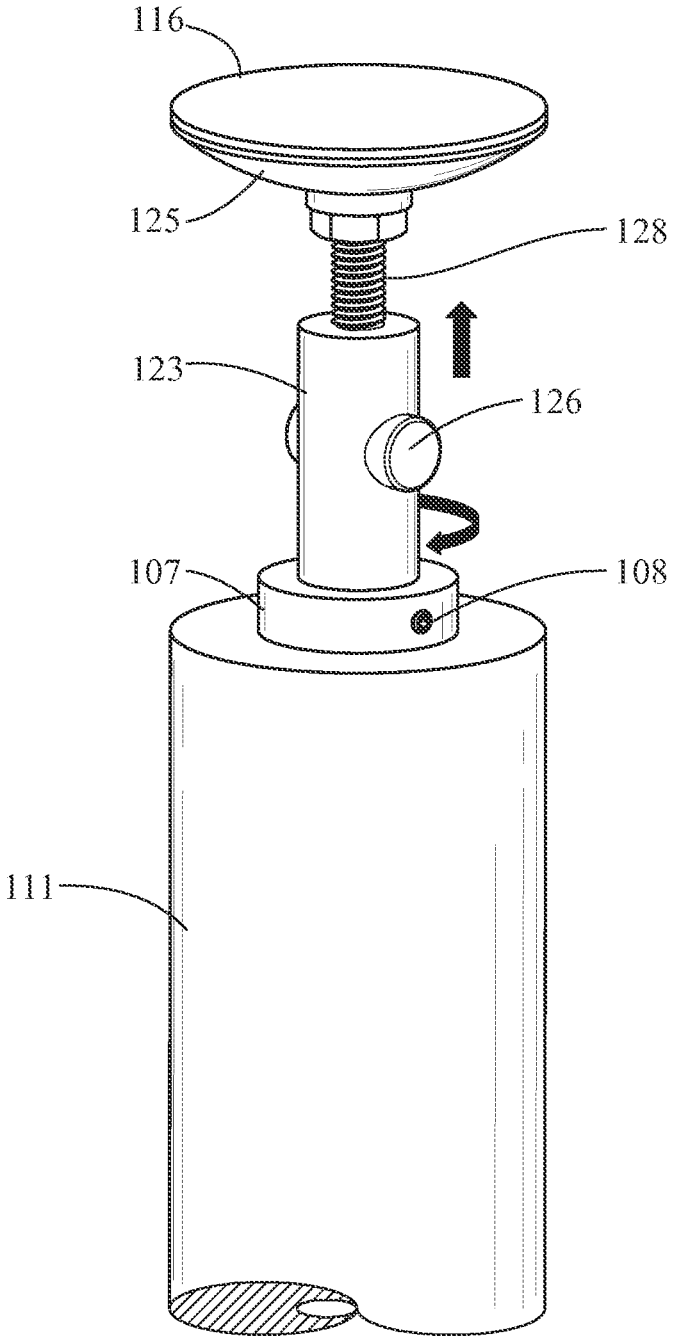
FIG. 5 shows a cross-section view of an adjustable pillar member including a cross-dowel.

Returning to FIGS. 1 and 4*a*-5, in one embodiment, an expansion plate 125 is secured to the distal end 124 of the elongated member 123. The expansion plate 125 may be secured to an insert 126 within the elongated member 123, secured directly to the distal end 124, or integral with the distal end 124 of the elongated member 123. For example, in one embodiment, securing the expansion plate 125 to the elongated member 123 includes positioning the insert 126 within the elongated member 123, then engaging a threaded member 128 extending from the expansion plate 125 with a corresponding threaded aperture in the insert 126. The insert 126 includes any article suitable for attachment to the elongated member 123, such as, but not limited to, an article configured to be positioned within the distal end 124 of the elongated member 123 (see FIGS. 4*a*-4*b*), a cross-dowel or other article configured to be positioned within an aperture extending through the elongated member 123 (see FIG. 5), or a combination thereof. In an alternate embodiment, the threaded member 128 may engage directly with a threaded aperture in the distal end 124 of the elongated member 123.

Suitable materials for the expansion plate 125 and/or the insert 126 include, but are not limited to, wood, metal, metal alloy, plastic, polymer, or a combination thereof. For example, in one embodiment, as illustrated in FIGS. 4*a*-4*b*, a plastic insert is positioned (e.g., forced/coupled) within the distal end 124 of the elongated member 123, then the threaded member 128 extending from a metal expansion plate is screwed into the threaded aperture of the insert 126. Alternatively, the expansion plate 125, the threaded member 128, the elongated member 123, and the base portion 111 may all be metal, with the threaded member 128 secured directly to the elongated member 123, which is movably disposed within the base portion.

The base portion 111 includes a first face 113, an opposing second face 115, and a channel 114 formed in the first face 113. The second face 115 is configured to be positioned proximal to one of the opposing surfaces 105, with the first face 113 extending away from second face 115 and towards the other opposing surface 105. The channel 114 extends from the first face 113 towards the second face 115, and is configured for movably receiving the elongated member 123. Suitable channels include any cavity, opening, or other geometrical shape capable of at least partially receiving the proximal end 122 of the elongated member 123 therein. For example, one suitable channel includes, but is not limited to, an aperture extending from the first face 113 towards the second face 115.

Figure 7:
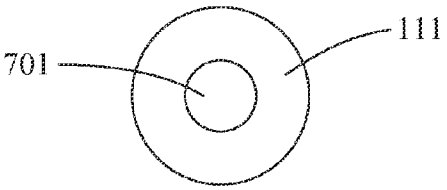
FIG. 7 shows a top view of a base section having a circular geometry.
Figure 8:
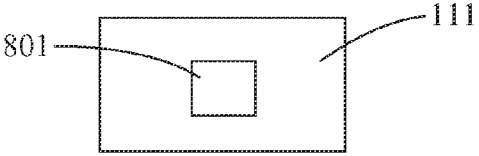
FIG. 8 shows a top view of a base section having a rectangular geometry.
Figure 9:
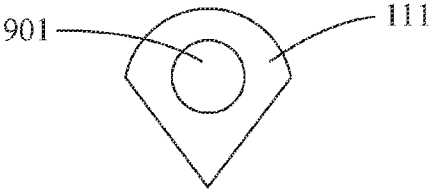
FIG. 9 shows a top view of a base section having a circular sector geometry.

The aperture or other channel includes any cross-sectional shape suitable for permitting adjustment and/or rotation of the elongated member 123 therein. The cross-sectional shape of the channel 114 is typically complementary to a cross-sectional shape of the elongated member 123 and/or a geometry of the base portion 111, and includes shapes such as, but not limited to, circular, substantially circular, symmetrical, substantially symmetrical, or a combination thereof. For example, in one embodiment, as illustrated in FIG. 7, the base portion 111 is circular, and includes a circular aperture 701 for receiving the elongated member 123 having a complementary circular cross-section. In an alternate embodiment, as illustrated in FIG. 8, the base portion 111 is non-circular, and includes a non-circular aperture 801 capable of slidably receiving the elongated member 123 having either a complementary or dissimilar cross-section. One example of a non-circular aperture 801 capable of receiving the elongated member 123 having a dissimilar cross-section includes a square aperture capable of rotatably receiving a circular elongated member therein. In another alternate embodiment, as illustrated in FIG. 9, the base portion 111 is non-circular (e.g., square, polygonal), and includes a circular aperture 901 for receiving the elongated member 123 having a complementary circular cross-section.

In one embodiment, a proximal end 122 of the elongated member 123 is insertable within, and fully separable from, the channel 114 in the base portion 111. Alternatively, the expansion portion 121 and/or the base portion 111 may include a stopping member that permits adjustment of the expansion portion 121 while maintaining the proximal end 122 of the elongated member 123 at least partially disposed within the base portion 111, which discourages separation of the expansion portion 121 and the base portion 111. The base portion 111 is formed from any material or combination of materials that facilitates sliding, rotating, or otherwise moving the expansion portion 121 relative to the base portion 111. Suitable materials of the base portion 111 include, but are not limited to, wood, engineered wood, metal, metal alloy, plastic, polymer, or a combination thereof. The base portion 111 and the expansion portion 121 may include the same or substantially the same materials, such as a steel base portion 111 and a steel elongated member 123, or may differ, such as a wooden base portion 111 and a metal elongated member 123.

As illustrated in FIG. 4*a*, retracting the elongated member 123 within the base portion 111 decreases a size of the adjustable pillar member 101 relative to the opposing surfaces 105. In the retracted position, the decreased size of the adjustable pillar member 101 facilitates moving and/or arranging the adjustable pillar member 101 relative to the opposing surfaces 105. Conversely, as illustrated in FIG. 4*b*, extending the elongated member 123 from the base portion 111 increases a size of the adjustable pillar member 101 relative to the opposing surfaces 105. By extending the elongated member 123, the adjustable pillar member 101 may be brought into contact with the opposing surfaces 105, which fixes a position of the adjustable pillar member 101 between the opposing surfaces 105.

In one embodiment, a locking member 107 (see FIGS. 1 and 4*a*-5) is provided to maintain a position of the expansion portion 121 relative to the base portion 111. The locking member 107 includes any component for reducing or eliminating retraction, while permitting rotation of the expansion portion 121. Suitable locking members include, but are not limited to, a shaft collar, a pin, a clip, a clamp, a ratchet, or a combination thereof. The locking member 107 is reversibly coupled to the expansion portion 121 and configured to restrict retraction of the expansion portion 121 upon contact with the base portion 111. Coupling the locking member 107 includes positioning the locking member 107 relative to the expansion portion 121 and the base portion 111, then tightening a setscrew 108 or other securing means to the expansion portion 121. When separate from the base portion 111, the locking member 107 permits extension and/or rotation of the expansion portion 121 relative to the base portion 111. To restrict both extension and refraction of the expansion portion 121, the locking member 107 may also be formed integral with, and/or rotatably coupled to, the base portion 111. Alternatively, the elongated member 123 includes a plurality of ridges, and the base portion 111 includes at least one ratchet head. Together, the ridges and the at least one ratchet head reduce or eliminate retraction of the expansion portion 121, while still permitting rotation of the elongated member 123.

Referring to FIGS. 1-5, in one embodiment, installation of the wall system 100 includes assembling the adjustable pillar member 101, positioning one or more of the adjustable pillar members 101 between the opposing surfaces 105, fixing the adjustable pillar members 101 in position, and securing one or more of the panel members 103 to the adjustable pillar members 101. In another embodiment, assembling the adjustable pillar member 101 includes insertion of the expansion portion 121 into the base portion 111. Additional assembly may include securing the base plate to the second face 115, positioning the insert 126 within the elongated member 123, securing the expansion plate 125 to the distal end 124 of the elongated member 123, or a combination thereof.

Positioning one or more of the adjustable pillar members 101 includes arranging the adjustable pillar members 101 with the second face 115 of the base portion 111 proximal to one of the opposing surfaces 105, and the distal end 124 of the elongated member 123 proximal to the other opposing surface 105. For example, the second face 115 may be positioned proximal to the floor, with the first face 113 and/or the distal end 124 of the elongated member 123 extending towards the ceiling. After arranging, the adjustable pillar members 101 are leveled and fixed in position. Fixing the adjustable pillar members 101 in position includes extending the expansion portion 121 from the base portion 111 of each of the adjustable pillar members 101. The extension of the expansion portion 121 increases a length of the adjustable pillar member 101, which, when in contact with both of the opposing surfaces 105, applies a pressure between the opposing surfaces 105. The pressure applied between the opposing surfaces 105 fixes the adjustable pillar member 101 in position without leaving marks or holes in the surrounding structures. Additionally, applying pressure to fix the adjustable pillar member 101 between the opposing surfaces 105 provides increased stability as compared to hinged or free-standing dividers. Furthermore, the retraction and extension of the expansion portion 121 permits installation of the adjustable pillar member 101 between opposing surfaces 105 including varying distances. For example, each of the adjustable pillar members 101 may be installed between opposing surfaces 105 having heights of between about 6 feet and about 15 feet. In another embodiment, each of the adjustable pillar members 101 may be installed between opposing surfaces 105 having a height of at least 7'3".

In one embodiment, extending the expansion portion 121 includes extending the elongated member 123 from the base portion 111, according to one or more of the embodiments disclosed herein. The extension of the elongated member 123 brings the adjustable pillar member 101 in contact with the opposing surfaces 105, after which coupling of the locking member 107 to the expansion portion 121 maintains the extension of the elongated member 123. The elongated member 123 may contact one of the opposing surfaces 105 directly, or the expansion plate 125 may contact one of the opposing surfaces 105 during extension of the elongated member 123. For example, in one embodiment, the expansion portion 121 includes the internally threaded member 501 with the expansion plate 125 rotatably and integrally secured to the distal end 124, such as, but not limited to, by a ball and socket joint. Rotation of the internally threaded member 501 in the first direction extends the elongated member 123 from the base portion 111, while contact between one of the opposing surfaces 105 and the expansion plate 125 maintains the rotational position of the expansion plate 125 with respect to the opposing surfaces 105. The ball and socket joint permits maintaining the position of the expansion plate 125 during rotation of the elongated member 123 without extending the expansion plate 125 from the distal end 124.

Alternatively, extending the expansion portion 121 includes extending the elongated member 123 from the base portion 111 and/or extending the expansion plate 125 from the elongated member 123. For example, in one embodiment, after extending the elongated member 123 and coupling the locking member 107 to the expansion portion 121, the expansion plate 125 is extended from the distal end 124 to facilitate fixing the adjustable pillar member 101. In another embodiment, the positioning of the adjustable pillar member 101 positions the expansion plate 125 adjacent to, or in contact with, one of the opposing surfaces 105, permitting fixing of the adjustable pillar member 101 through extension of the expansion plate 125 without extending the elongated member 123. In a further embodiment, the expansion plate 125 and the elongated member 123 are simultaneously extended to fix the adjustable pillar member 101 in position.

The extension of the expansion plate 125 includes any suitable extension method, such as, but not limited to, rotation of the elongated member 123, the threaded member 128, and/or the expansion plate 125. In one embodiment, a rotational position of the expansion plate 125 with respect to the opposing surfaces 105 is maintained by contact with one of the opposing surfaces 105, such that rotation of the elongated member 123 in a first direction loosens the threaded member 128 extending from the expansion plate 125. The loosening of the threaded member 128 extends the expansion plate 125 away from the distal end 124 of the elongated member 123, which increases the length of the adjustable pillar member 101 to fix the adjustable pillar member 101 in position. A rotation of the elongated member 123 in a second direction tightens the threaded member 128 extending from the expansion plate 125, which retracts the expansion plate 125 for adjustment and removal of the adjustable pillar member 101. During simultaneous extension, when the expansion portion 121 includes the internally threaded member 501, rotation of the elongated member 123 in the first direction extends both the elongated member 123 and the expansion plate 125.

In one embodiment, the second face 115 of the base portion 111 and/or the expansion plate 125 includes a coating 116, such as, but not limited to, a non-slip rubberized coating. The coating 116 reduces or eliminates slipping of the adjustable pillar member 101 and/or damage to the opposing surfaces 105 from the second face 115 and/or the expansion plate 125. The coating 116 on the second face 115 may be the same as, similar, substantially similar, or dissimilar to the coating 116 on the expansion plate 125. In another embodiment, a base plate is secured to the second face 115 and/or positioned between the second face 115 and the opposing surface 105, the base plate including the coating 116. The base plate includes a geometry that is either complementary to, or dissimilar from, the geometry of the base portion 111. Suitable materials for the base plate include, but are not limited to, plastic, wood, metal, metal alloy, or a combination thereof.

After positioning and/or fixing the one or more adjustable pillar members 101, securing one or more of the panel members 103 to the adjustable pillar members 101 maintains a position of the panel members 103 relative to the adjustable pillar members 101. The at least one adjustable pillar member 101 is preferably fixed in position prior to securing one or more of the panel members 103 thereto, however, as will be appreciated by those skilled in the art, one or more of the adjustable pillar members 101 may be fixed in position and/or adjusted subsequent to securing one or more of the panel members 103.

Figure 10:
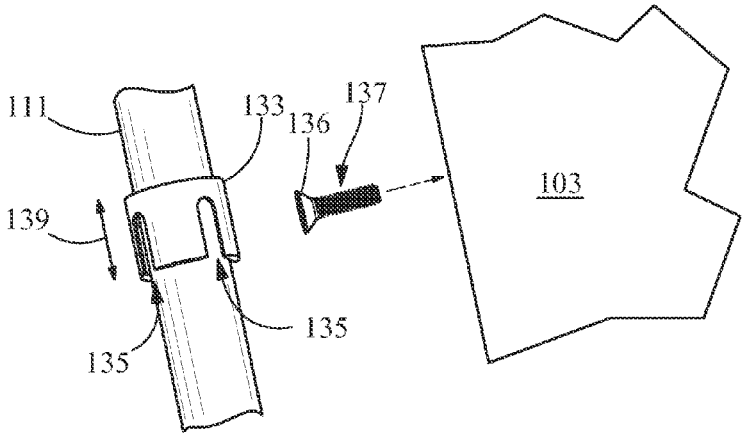
FIG. 10 shows an exploded view of a support article, according to an embodiment of the disclosure.

Securing the one or more panel members 103 to the adjustable pillar members 101 includes attaching the panel member 103 to the adjustable pillar member 101 with a support article 131. The support article 131 includes any article configured to maintain a position of the panel member 103 relative to the adjustable pillar member 101. Referring to FIGS. 1-5, in one embodiment, the support article 131 includes a connector 133 positioned around the base portion 111. The connector 133 includes any shape capable of being positioned around the base portion 111 and sliding in an axial direction 139 thereon, such as, but not limited to, a cylindrical connector, a ring, a square connector having a central opening, or any other geometry having a central opening for receiving the adjustable pillar member 101 therein. A female portion 135 or a male portion 137 is provided on the connector 133, with a corresponding male portion 137 or female portion 135 provided on the panel member 103. For example, as best seen in FIG. 10, the female portion 135 includes a groove formed in the connector 133, and the male portion 137 includes a screw extending from the panel member 103. Alternatively, the connector 133 may include the male portion 137 extending therefrom, while the panel member 103 includes the female portion 135 formed therein. To secure the panel member 103 to the adjustable pillar member 101, the connector 133 is slid along the adjustable pillar member 101 to position the male portion 137 within the corresponding female portion 135. Once positioned within the female portion 135, a head portion 136 of the male portion 137 restricts non-axial disengagement of the male portion 137 and the female portion 135, which secures the panel member 103 to the adjustable pillar member 101. Although shown as a groove and a screw, as will be appreciated by those skilled in the art, the female portion 135 may include any opening suitable for receiving any corresponding male portion 137 therein.

As illustrated in FIG. 10, additional female portions 135, or male portions 137, may be provided in the connector 133 to facilitate securing more than one panel member 103 to each of the adjustable pillar members 101. For example, each connector 133 may include two female portions 135 at a 90° angle relative to each other, two female portions 135 at 180°, three female portions 135 at 90°, four female portions 135 at 90°, or a combination thereof. As will be appreciated by those skilled in the art, the connector 133 is not limited to the above mentioned configurations, but instead may include any suitable number of female portions 135 arranged at any suitable angle to provide a desired configuration of the wall system 100.

Figure 11B:
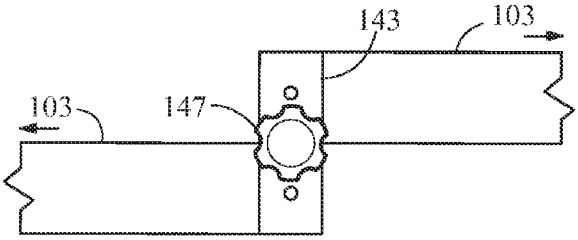
FIG. 11*b* shows a bottom view of the leveling device of FIG. 11*a*.
Figure 11A:
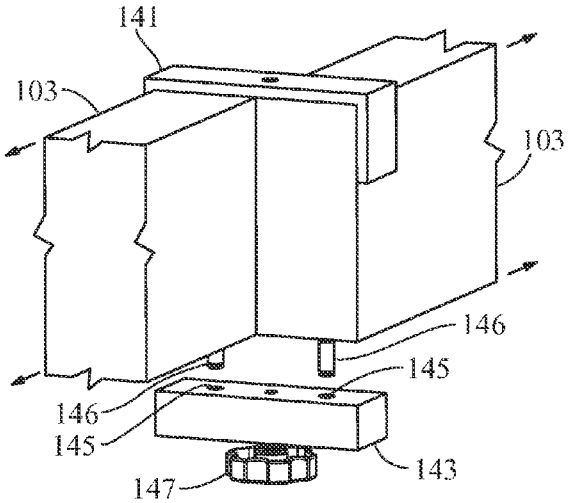
FIG. 11*a* shows a perspective view of a clasp and a leveling device securing two panel members together, according to an embodiment of the disclosure.

Referring to FIGS. 1-2 and 11*a*-12, in one embodiment, a clasp 141 and/or a leveling device 143 is provided to secure one or more of the panel members 103 to each other. As best illustrated in FIG. 11*a*, in another embodiment, one or more of the clasps 141 are positioned over two adjacent panel members 103, the clasp(s) 141 clamping the panel members 103 together. The clasp(s) 141 may be positioned over a top portion of the panel members 103, a bottom portion of the panel members 103, or a combination thereof. Each of the clasps 141 is formed from a material having strength suitable for clamping the panel members 103, such as, but not limited to, extruded aluminum, and includes an interior dimension that is, or can be, adjusted to twice the width of the panel member 103. In an alternate embodiment, the clasp 141 is positioned over abutting and/or aligned panel members 103, such that one of the panel members 103 is received within a first side of the clasp 141, and the other panel member 103 is received in an opposite second side of the clasp 141.

Figure 12:
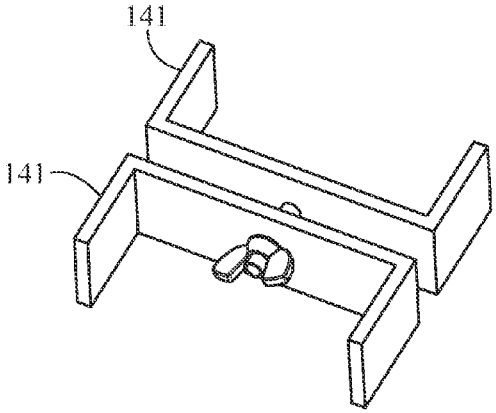
FIG. 12 shows an alternate leveling device, according to an embodiment of the disclosure.

Turning to FIGS. 11*a*-11*b*, in one embodiment, the leveling device 143 includes a top surface having at least two openings 145 formed therein, and a bottom surface with a leveling member 147 extending therefrom. At least one positioning member 146 is secured to the bottom of each of the panel members 103, each positioning member 146 corresponding to one of the at least two openings 145 forming in the top surface of the leveling device 143. The positioning member 146 includes any article suitable for insertion within the openings 145, such as, but not limited to, a screw and spacer secured to the panel member 103. Once inserted within the openings 145, the positioning members 146 maintain a position of the panel members 103 relative to the leveling device 143, while the leveling member 147 is adjusted to level the panel members 103. Alternatively, as illustrated in FIG. 12, the leveling device 143 includes two of the clasps 141 facing in opposite directions relative to each other. Each of the clasps 141 has an aperture formed therein, the apertures corresponding to each other to facilitate insertion of a threaded member therethrough. One of the clasps 141 is positioned over the bottom of the panel members 103, while the other clasp 141 of the leveling device 143 faces the floor. To level the panel members 103, the threaded member and/or a nut engaging the threaded member is rotated, the rotation moving one of the clasps 141 relative to the other.

Figure 13:
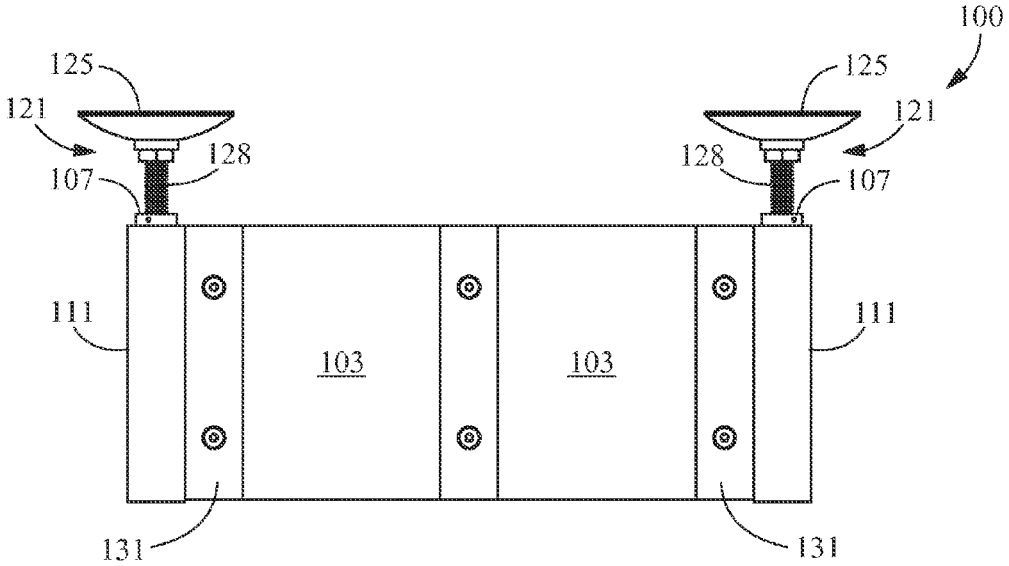
FIG. 13 shows a front view of a wall system including alternate support articles, according to an embodiment of the disclosure.
Figure 14:
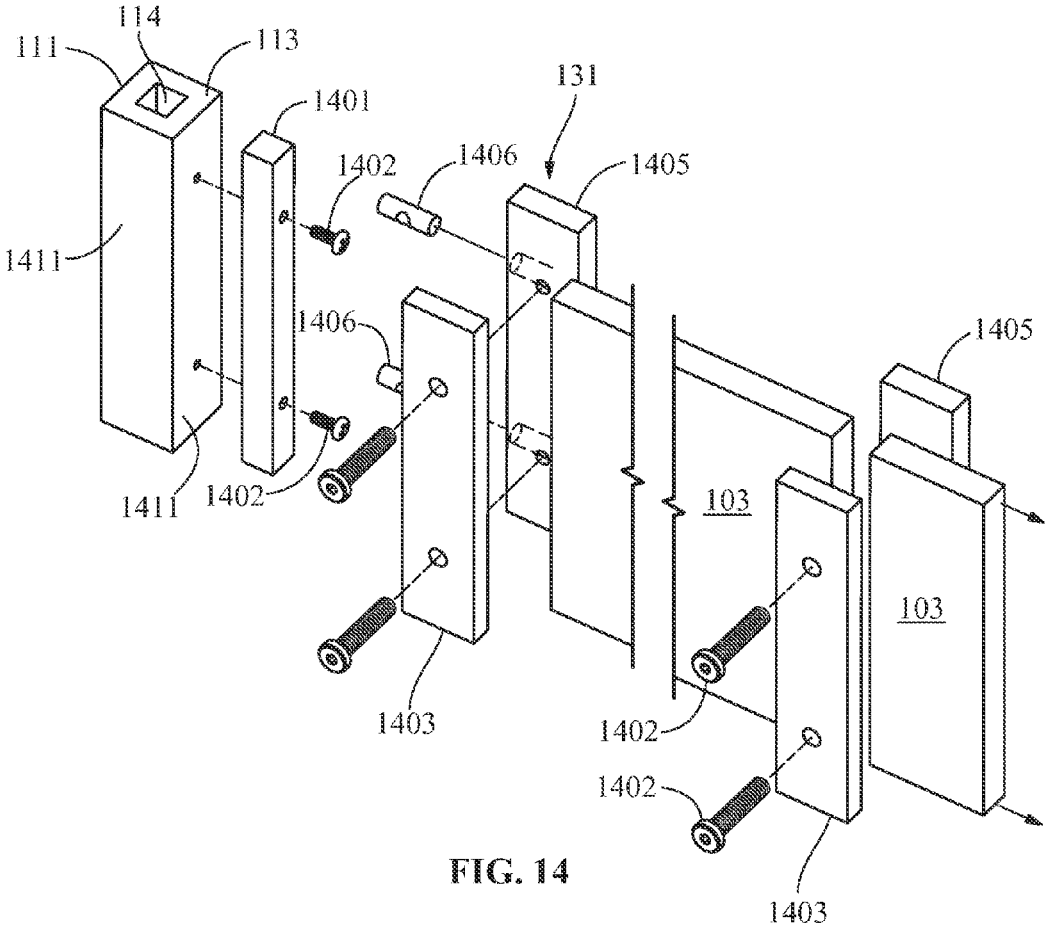
FIG. 14 shows an exploded perspective view of a wall system, according to an embodiment of the disclosure.

In an alternate embodiment, as illustrated in FIGS. 13-14, the support article 131 includes an attachment member 1401, a first pressure plate 1403, and a second pressure plate 1405. The attachment member 1401 is attached to the adjustable pillar member 101 by any suitable attachment method. For example, one attachment method includes using fastening elements 1402, such as, but not limited to, ready-to-assemble (RTA) bolts or other threaded members. The fastening elements 1402 are inserted through any suitable number of pre-drilled holes in the attachment member 1401, and tightened to complementary integral receiving portions in the adjustable pillar member 101. For example, the complementary integral receiving portions may include threaded metal inserts provided in columns distributed on one or more sides 1411 of the base portion 111. Although the base portion 111 is shown as a square in FIG. 14, the base portion 111 is not so limited, and may include any other geometry, such as, but not limited to, polygonal, rectangular, cylindrical, circular sector, triangular, or a combination thereof.

After attaching the attachment member 1401 to the base portion 111, the first pressure plate 1403 and the second pressure plate 1405 are tightened over the attachment member 1401 and a portion of the panel member 103 to secure the panel member 103 to the adjustable pillar member 101. For example, in one embodiment, the first pressure plate 1403 and the second pressure plate 1405 are arranged opposite each other, with the attachment member 1401 and a portion of the panel member 103 positioned between the pressure plates 1403, 1405. The fastening elements 1402 are inserted through pre-drilled holes in the first pressure plate 1403, and tightened to corresponding tightening elements in the second pressure plate 1405. For example, in one embodiment, the second pressure plate 1405 includes cross-dowels having a threaded opening inserted into holes formed therein, the threaded opening of the cross-dowels aligning with the pre-drilled holes in the first pressure plate 1403. Tightening the fastening elements 1402 applies clamping pressure to the panel member 103 and the attachment member 1401, which secures the panel member 103 to the adjustable pillar member 101.

The first pressure plate 1403, the second pressure plate 1405, and/or the attachment member 1401 are manufactured from any suitable material, such as, but not limited to, wood, metal, metal alloy, plastic, polymer, any material for applying pressure to the at least one panel member 103, or a combination thereof. For example, in one embodiment, the first pressure plate 1403 and the second pressure plate 1405 are manufactured from engineered wood, are faced on both sides, and edge-banded.

In one embodiment, additional attachment members 1401 are attached at the sides 1411 of the base portion 111 to facilitate securing of multiple panel members 103 to the adjustable pillar member 101. When two or more of the attachment members 1401 are attached to the adjustable pillar member, a geometry of the base portion 111 and/or a positioning of the attachment members 1401 on the base portion 111 determines an orientation of the attachment members 1401 relative to each other. The orientation of the attachment members 1401 relative to each other controls the positioning of any panel members 103 attached to the adjustable pillar member 101. In one embodiment, the attachment members 1401 are positioned about 90° relative to each other to provide perpendicular, or substantially perpendicular, panel members 103 (see FIG. 3). For example, the attachment members 1401 on consecutive sides 1411 of the base portion 111 having square, rectangular, or circular sector geometry, or on non-consecutive sides 1411 of the base portion 111 having a polygonal or octagonal geometry, provide perpendicular, or substantially perpendicular panel members 103. In another embodiment, the attachment members 1401 are positioned at any suitable angle relative to each other to provide any suitable orientation of the panel members 103 other than 90°. For example, the attachment members 1401 on consecutive sides 1411 of the base portion 111 having the octagonal geometry provide panel members 103 at about 45° relative to each other.

Installation of multiple adjustable pillar members 101 having varying geometries and/or attachment member 1401 positioning provides an increased number of different configurations for the wall system 100. For example, assembling the wall system 100 with multiple adjustable pillar members 101 including both square and polygonal geometries permits configuring the wall system 100 to include the panel members 103 at either 45° or 90°, relative to each other.

Figure 15:
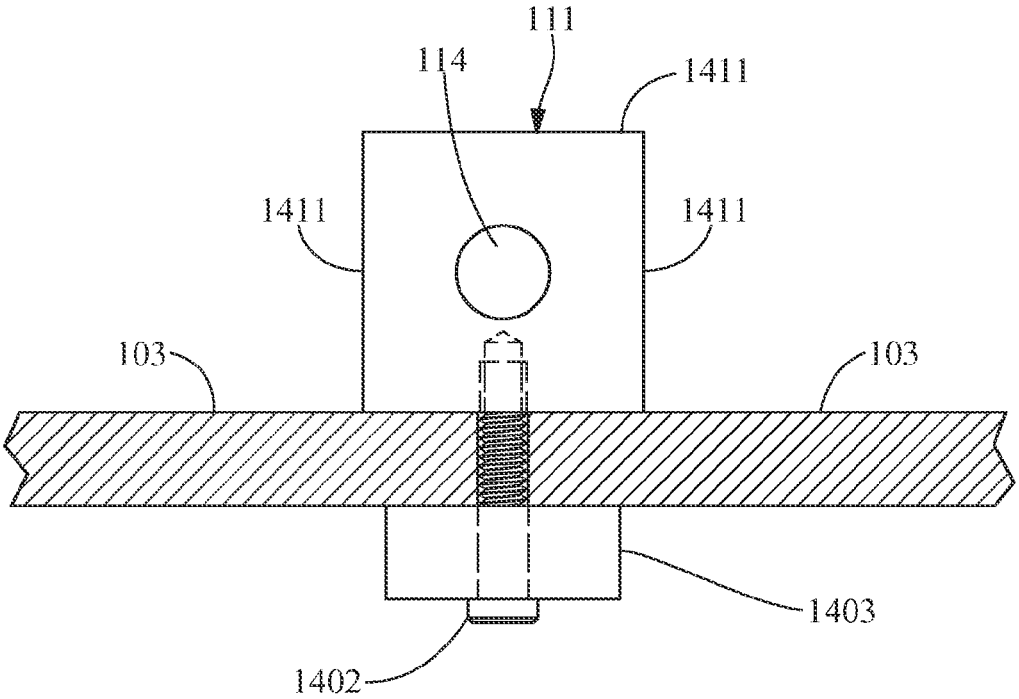
FIG. 15 shows a top view of two panel members secured directly to a base portion with a pressure plate.

Referring to FIG. 15, in another embodiment, the first pressure plate 1403 is secured directly to the adjustable pillar member 101 to maintain the position of the at least one panel member 103. When the fastening elements 1402 extending through the first pressure plate 1403 are tightened, the first pressure plate 1403 is drawn towards the adjustable pillar member 101, which applies pressure to anything positioned there between. In one example, two adjacent panel members 103 are secured to an additional adjustable pillar member 101 using the first pressure plate 1403. The two adjacent panel members 103 are positioned between the first pressure plate 1403 and the additional adjustable pillar member 101, one panel member 103 being on either side of the fastening elements 1402 extending between the first pressure plate 1403 and the additional adjustable pillar member 101. The tightening of the fastening elements 1402 draws the first pressure plate 1403 towards the additional adjustable pillar member 101 and applies pressure to both of the panel members 103. The pressure applied to the panel members 103 reduces or eliminates movement of the panel members 103 with respect to the adjustable pillar member 101.

Figure 16:
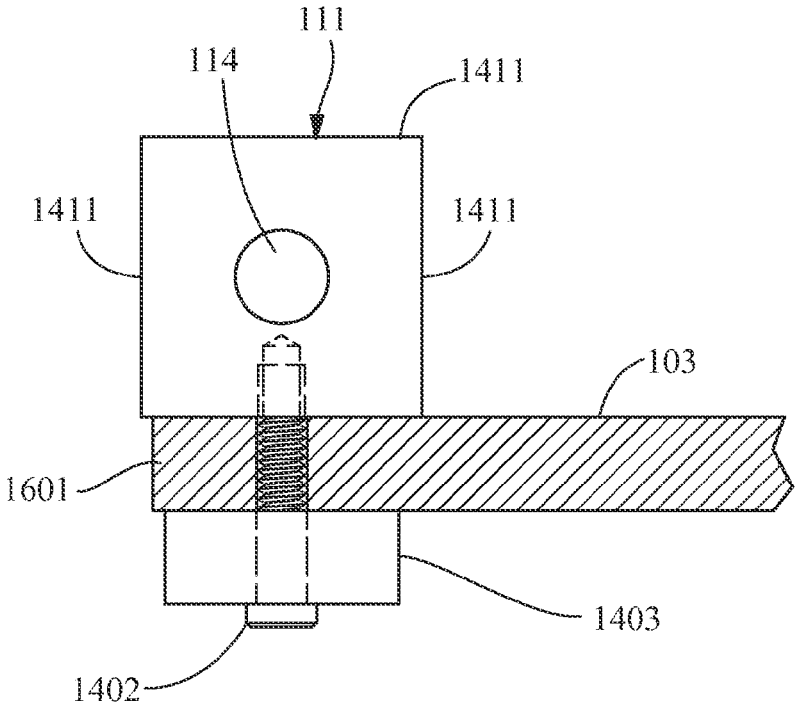
FIG. 16 shows a top view of a single panel member secured directly to a base portion with a pressure plate.

In a further embodiment, as illustrated in FIG. 16, one of the panel members 103 is positioned between the first pressure plate 1403 and the adjustable pillar member 101, and a spacer 1601 is positioned opposite the fastening elements 1402, as compared to the panel member 103. Suitable materials for the spacer 1601 include, but are not limited to, wood, engineered wood, metal, metal alloy, plastic, polymer, or a combination thereof. For example, the spacer 1601 may be formed from the same material as the panel member 103 and/or include a segment of a panel member configured to be positioned between the base portion 111 and the first pressure plate 1403 without extending past the edge of the base portion 111. The tightening of the fastening elements 1402 applies pressure to both the panel member 103 and the spacer 1601, thus reducing or eliminating a tipping of the first pressure plate 1403 as well as movement of the panel member 103 during and/or subsequent to tightening of the fastening element 1402. In one embodiment, the spacer 1601 material and/or thickness is similar, or substantially similar, to the at least one panel member 103, providing increased balance of the pressure provided by the tightening of the fastening elements 1402.

Figure 17:
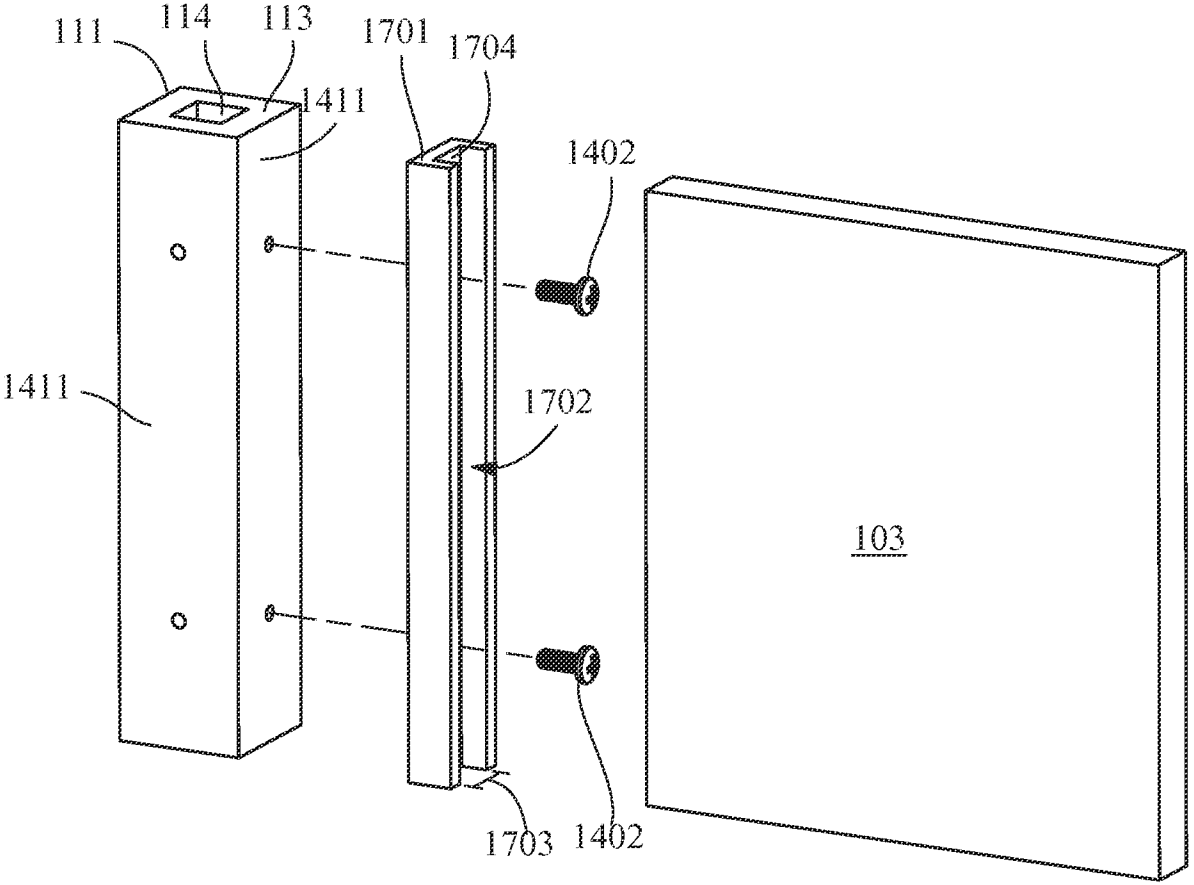
FIG. 17 shows an exploded perspective view of a portion of a wall system including a cap molding, according to an embodiment of the disclosure.

In an alternate embodiment, as illustrated in FIG. 17, a cap molding 1701 is used to maintain the position of the at least one panel member 103. The cap molding 1701 includes a receiving portion 1702 for receiving an edge of the panel member 103 therein. In a further embodiment, an opening 1703 to the receiving portion 1702 is reduced in size as compared to a face 1704 opposite the opening 1703, such that upon insertion of the panel member 103 into the receiving portion 1702 the sides of the cap molding 1701 apply pressure to the panel member 103. After the cap molding 1701 is attached to the adjustable pillar member 101, and the edge of the panel member 103 is positioned within the receiving portion 1702, the cap molding 1701 reduces or eliminates lateral movement of the panel member 103 with respect to the adjustable pillar member 101. The cap molding 1701 is manufactured from any suitable material, such as, but not limited to, wood, metal, metal alloy, plastic, polymer, or a combination thereof. For example, in one embodiment, the cap molding 1701 includes plastic divider molding.

Returning to FIGS. 13-14, when two or more of the panel members 103 are positioned between the adjustable pillar members 101, the panel members 103 may be connected to each other using the first pressure plate 1403, the second pressure plate 1405, and the fastening elements 1402. The first pressure plate 1403 and the second pressure plate 1405 connect the panel members 103 to each other in the same way they are used to connect the panel member 103 to the attachment member 1401. When a plurality of the panel members 103 are positioned in series, one or more additional adjustable pillar members 101 are preferably used to provide increased support for the panel members 103 as compared to multiple attachments with the first pressure plate 1403 and the second pressure plate 1405 alone.

The installation of the wall system 100 formed according to one or more of the embodiments disclosed herein creates new spaces, and/or divides existing spaces to provide creative and/or efficient use of the existing spaces. In one embodiment, varying an orientation and/or position of at least one of the multiple adjustable pillar members 101 varies a configuration of the wall system 100, permitting a plurality of different configurations selectable by an individual. For example, various configurations of the wall system 100 include, but are not limited to, creating privacy in a shared room (e.g., bedroom, any other room, for a guest), creating closet space in any room, separating spaces (e.g., entryways, pantries, laundry rooms, nurseries) from the rest of a living area, creating a space for displaying and/or hanging articles (e.g., art, mirrors, coats), providing walls for children to decorate and/or personalize (e.g., create their own personal/private bedroom spaces), or a combination thereof. In another embodiment, differing panel members 103 are secured to the multiple adjustable pillar members 101 to provide varying features in the wall system 100, such as, but not limited to, design, color, size, or a combination thereof. In a further embodiment, additional adjustable pillar members and/or additional panel members may be easily added to the wall system 100 at any time.

Figure 18:
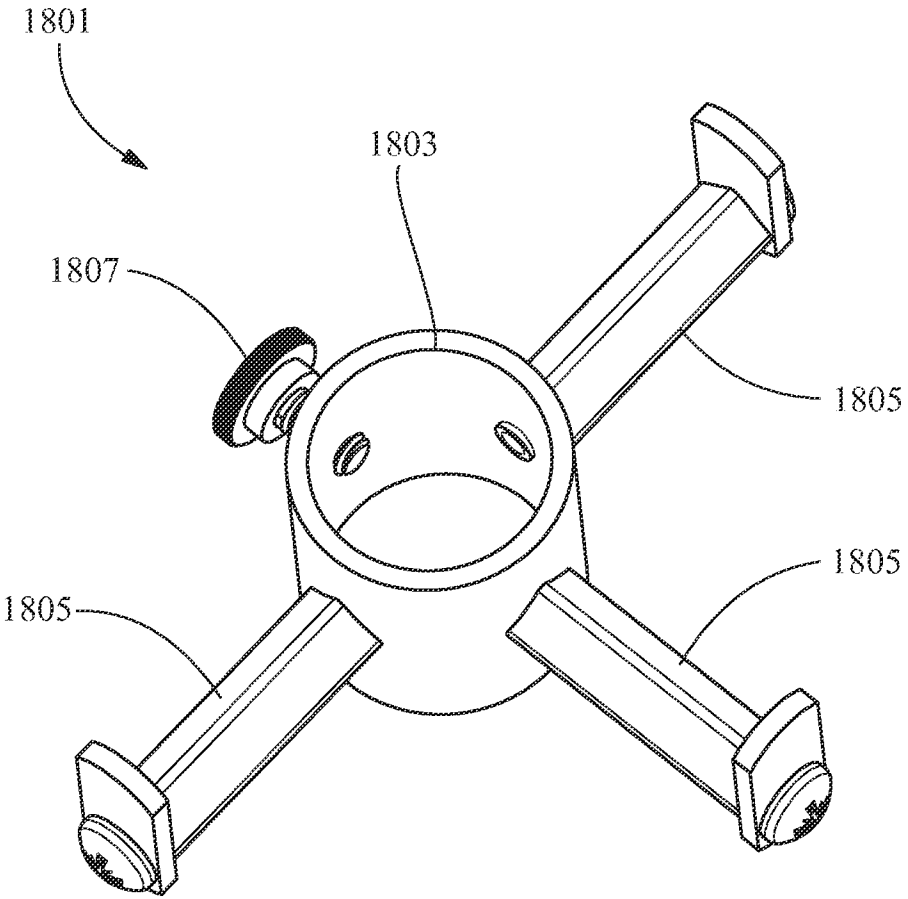
FIG. 18 shows a perspective view of an accessory bracket, according to an embodiment of the disclosure.

Additionally, referring to FIG. 18, the wall system 100 may include an accessory bracket 1801 adjustably secured to at least one of the adjustable pillar members 101. A body portion 1803 of the accessory bracket 1801 is movably positioned over the base portion 111 and/or the elongated member 123, and includes one or more arm members 1805 extending therefrom. A tightening member 1807, such as a thumb screw, facilitates detachably securing the accessory bracket 1801 to the adjustable pillar members 101, while the arm members 1805 facilitate hanging of items therefrom. In one embodiment, one or more of the accessory brackets 1801 are adjustably secured to at least one of the adjustable pillar members 101 of the wall system 100. Alternatively, one or more of the accessory brackets 1801 are secured to at least one of the adjustable pillar members 101, separate from the panel members 103. The adjustable pillar member 101 and the accessory bracket(s) 1801 separate from the panel members 103 provide an adjustable storage member for hanging items therefrom.

The configuration of the wall system 100 permits assembly of the wall system 100 by an individual having no special building skills, and may be erected with as little as two tools (e.g., Allen wrench and level). In one embodiment, when installed as directed, the wall system 100 complies with municipal building codes, and does not require a permit for erection. In another embodiment, the wall system 100 may be assembled in less than one hour, and may be disassembled in less than 10 minutes. After disassembly, the individual components of the wall system 100 permit easy transportation and storage (e.g., in a closet, a garage, or a basement). Depending on the materials used, the individual components of the wall system 100 include decreased weight as compared to other wall systems. For example, in one embodiment, a base portion 111 is manufactured with engineered wood and weighs five pounds or less. In another embodiment, the at least one panel member 103 weighs about twelve pounds.

The invention has been reduced to practice and the following examples are included by way of illustration only, and are not intended to limit the scope of the disclosure.

EXAMPLE 1

In one embodiment, the base portion 111 of the adjustable pillar member 101 includes a round tubular steel pole. The elongated member 123 of the expansion portion 121 includes a 1" diameter steel pole formed in two sections 601, and configured to slide within the base portion 111. Assembly of the adjustable pillar member 101 includes attaching the base portion 111 to a base plate, rotating a 5'8" threaded coupling in one of the two sections 601 along a ⅝" threaded stud 604 to form the elongated member 123, and inserting the proximal end 122 of the elongated member 123 into the channel 114 forming the base portion 111. The expansion plate 125 is then secured to the distal end 124 of the elongated member 123.

After assembling the adjustable pillar member 101, the adjustable pillar member 101 is positioned between the opposing surfaces 105, which include the floor and the ceiling, and the expansion portion 121 is extended between the opposing surfaces 105. The locking member 107, which includes a shaft collar with a setscrew 108, is tightened in place around the expansion portion 121 to restrict retraction of the elongated member 123 within the base portion 111. Once the locking member 107 is secured, the adjustable pillar member 101 is leveled and the expansion plate 125 is extended from the elongated member 123 to contact the ceiling. Extension of the expansion plate 125 applies pressure to the opposing surfaces 105 through the adjustable pillar member 101. The pressure applied through the adjustable pillar member 101 fixes the adjustable pillar member 101 in position, providing support for installation of the panel members 103.

The panel members 103 are then attached to the fixed adjustable pillar members 101. Attaching a first panel member 103 to a first adjustable pillar member 101 includes inserting two of the male portions 137 into the first panel member 103, positioning the first panel member 103 adjacent to the first adjustable pillar member 101, and moving the connectors 133 along the first adjustable pillar member 101 to contact the male portions 137. When contacted by the connectors 133, the heads 136 of the male portions 137 are positioned between the connectors 133 and the adjustable pillar member 101, with the male portions 137 extending through the female portions 135 in the connectors 133. The male portions 137 include screws and the connectors 133 include tubular pieces configured to be positioned around, and slide relative to, the adjustable pillar member 101. A second panel member 103 is positioned adjacent to the first panel member 103 and secured to a second adjustable pillar member 101 in the same manner as described above with regard to the first panel member 103. After securing the panel members 103 to the adjustable pillar members 101, the adjacent panel members 103 are secured to each other with one or more of the clasps 141, and then the panel members 103 are leveled with the leveling device 143. Together, the first and second panel members 103, the first and second adjustable pillar members 101, and any additional panel members 103 and/or adjustable pillar members 101 form the wall system 100.

EXAMPLE 2

In one embodiment, the base portion 111 of the adjustable pillar member 101 is manufactured with engineered wood that is faced on both sides, then miter-folded. The miter-folding forms the channel 114, which includes a hollow section extending through the base portion 111. The hollow section formed by the miter-folding is cleaned of protruding materials (e.g., excess glue) to permit sliding of the expansion portion 121, which includes a metal expansion pipe, within the hollow section. The threaded metal inserts are inserted in columns on three consecutive sides 1411 of the base portion 111, each column including four threaded metal inserts for a total of twelve inserts per base portion 111.

After manufacturing and miter-folding the base portion 111, assembly of the adjustable pillar member 101 includes attaching the base plate to the base portion 111. The base plate includes a floor plate, which is a square plastic plate that sits on the floor. A bottom portion of the floor plate includes the non-slip rubberized coating 116 to reduce or eliminate slipping of the base portion 111 and/or damage to the floor. Next, the elongated member 123 of the expansion portion 121, which includes a 0.75 inch metal expansion pipe, is inserted within the channel 114 in the base portion 111, and the locking member 107, which includes a shaft collar, is tightened in place with the setscrew 108 to inhibit the elongated member 123 from fully retracting inside the base portion 111. The metal expansion pipe slides within the hollow section, permitting extension of the expansion portion 121 above the base portion 111, toward the ceiling. The insert 126, which includes a round plastic insert having a threaded aperture for receiving a bolt, is pounded into the distal end 124 of the elongated member 123. A bolt extending from the center of the expansion plate 125, which includes a round plastic ceiling plate, is fully threaded into the threaded aperture of the insert 126, the bolt being attached to the expansion plate 125 with a lock nut.

The assembled adjustable pillar member 101 is held vertically in place between the floor and the ceiling, and the elongated member 123 is raised until the expansion plate 125, which includes the non-slip rubberized coating 116, is snug against the ceiling. The setscrew 108 in the locking member 107 is loosened to permit the shaft collar to fall until it rests upon the base portion 111. While the elongated member 123 is extended and the locking member 107 is resting upon the base portion 111, the setscrew 108 is retightened to maintain the expansion portion 121 in place relative to the base portion 111. Subsequent to raising the elongated member 123 and securing the locking member 107, the adjustable pillar member 101 is leveled vertically in two vertical dimensions. The elongated member 123 is then rotated (e.g., turned clockwise) to extend the expansion plate 125 from the distal end 124 of the elongated member 123, which expands the adjustable pillar member 101, and applies pressure on the floor and ceiling. The pressure applied through the adjustable pillar member 101 fixes the adjustable pillar member 101 in position, providing support for installation of the at least one panel member 103.

Next, the fastening elements 1402, which include RTA connector bolts, are inserted through pre-drilled holes in one of the attachment members 1401 and into the threaded metal inserts in one of the base portions 111. The RTA connector bolts and/or cap nuts are then tightened to attach the attachment member 1401 to the base portion 111. The attachment member 1401 and the base portion 111 form a first attachment member and a first base portion of a first adjustable pillar member. After attaching the attachment member 1401 to the base portion 111, the attachment member 1401 and one of the panel members 103 are positioned between the first pressure plate 1403 and the second pressure plate 1405. The pressure plates 1403, 1405 are then tightened to each other using connector bolts and cross-dowels to apply a clamping pressure to the attachment member 1401 and the panel member 103. The clamping pressure secures the panel member 103 to the base portion 111, providing a first panel member secured to the first adjustable pillar member. An additional panel member 103 is similarly secured to an additional attachment member 1401 of another base portion 111, to form a second panel member secured to a second adjustable pillar member. The first panel member, the second panel member, and/or any additional panel members are connected to each other with the first pressure plate 1403 and the second pressure plate 1405. Together, the adjustable pillar member and the panel members form the wall system 100.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and all other patentable subject matter contained herein.

What is claimed is:

1. A wall system, comprising:

an adjustable pillar member including:

a base portion having a first face and an opposing second face;

a channel formed in the first face, the channel extending from the first face towards the opposing second face; and an expansion portion movably disposed within the channel, the expansion portion at least partially extending from the first face of the base portion comprising an elongated member having a proximal end inserted within the base portion, a distal end extending from the base portion, and an expansion plate secured to the distal end;

wherein the elongated member includes a threaded opening formed therein, and the base portion includes a complementary threaded projection positioned within the channel, the elongated member being configured to extend from, and retract within, the channel formed in the base portion; and wherein the expansion plate includes a threaded member extending therefrom, the expansion plate being configured to extend from, and retract towards, the distal end of the elongated member;

a panel member; and a support article arranged and disposed to secure the panel member to the adjustable pillar member;

wherein the adjustable pillar member is configured to extend between opposing surfaces and support the panel member when secured thereto.

2. The wall system of claim 1, further comprising at least one additional adjustable pillar member.

3. The wall system of claim 2, wherein the panel member is secured to the adjustable pillar member and one of the at least one additional adjustable pillar members.

4. The wall system of claim 2, further comprising at least one additional panel member.

5. The wall system of claim 4, wherein the panel member and the at least one additional panel member are supported by the adjustable pillar member and the at least one additional adjustable pillar member.

6. The wall system of claim 4, further comprising a clasp positioned over the panel member and the at least one additional panel member, the clasp securing the panel member and the at least one additional panel member to each other.

7. The wall system of claim 6, further comprising a leveling device supporting the panel member and the at least one additional panel member between the adjustable pillar member and the additional adjustable pillar member.

8. The wall system of claim 1, wherein the elongated member comprises a metal post, and the base portion comprises a cylindrical metal base portion configured to at least partially receive the metal post therein.

9. The wall system of claim 1, wherein a non-stick coating is positioned over a surface selected from the group consisting of the second face of the base portion, a base plate secured to the second face of the base portion, the distal end of the elongated member, an outer surface of the expansion plate, and combinations thereof.

10. The wall system of claim 1, further comprising a locking member for restricting retraction of the expansion portion within the base portion.

11. The wall system of claim 1, wherein the support article includes at least one connector movably positioned around the adjustable pillar member.

12. The wall system of claim 11, wherein the connectors comprise cylindrical connectors configured to slide axially along the adjustable pillar member.

13. The wall system of claim 11, wherein the connectors include a female portion configured to receive a male portion extending from the panel member.

14. The wall system of claim 11, further comprising at least two panel members secured to the adjustable pillar member, wherein the connectors include at least two female portions, each female portion configured to receive a male portion extending from one of the panel members.

15. The wall system of claim 1, wherein the support article includes:

an attachment member attached to the base portion;

a first pressure plate;

a second pressure plate; and fastening elements coupling the first pressure plate to the second pressure plate;

wherein the first pressure plate and the second pressure plate are arranged and disposed to secure the at least one panel member to the attachment member upon tightening of the fastening elements.

16. The wall system of claim 1, wherein the panel member is selected from the group consisting of a door, a wood panel, a metal panel, a sheet of solid or opaque material, and combinations thereof.

17. The wall system of claim 1, wherein the adjustable pillar member provides support for the panel member without damaging surrounding structures.

18. A wall system, comprising:

at least two adjustable pillar members, each adjustable pillar member including:

a base portion having a first face and an opposing second face;

a channel formed in the first face, the channel extending from the first face towards the second opposing face; and an expansion portion movably disposed within the channel, the expansion portion including:

an elongated member having a proximal end inserted within the base portion, and a distal end extending from the base portion; and an expansion plate secured to the distal end;

wherein the elongated member includes a threaded opening formed therein, and the base portion includes a complementary threaded projection positioned within the channel, the elongated member being configured to extend from, and retract within, the channel formed in the base portion; and wherein the expansion plate includes a threaded member extending therefrom, the expansion plate being configured to extend from, and retract towards, the distal end of the elongated member;

at least two panel members;

a support article coupled to each of the adjustable pillar members, the support article arranged and disposed to secure at least one of the panel members to the adjustable pillar member;

a clasp for securing the panel members to each other; and a leveling device for supporting the panel members between the adjustable pillar members;

wherein the adjustable pillar member is configured to extend between opposing surfaces and provide support for the panel members when secured thereto.

* * * * *